US005462031A

United States Patent [19]

Kai

[11] Patent Number: 5,462,031

[45] Date of Patent: Oct. 31, 1995

[54] AIR-TO-FUEL RATIO CONTROL UNIT FOR INTERNAL COMBUSTION ENGINE

[75] Inventor: Manabu Kai, Iwata, Japan

[73] Assignee: Yamaha Hatsudoki Kabushiki Kaisha, Iwata, Japan

[21] Appl. No.: 157,884

[22] Filed: Nov. 24, 1993

[30] Foreign Application Priority Data

Nov. 24, 1992 [JP] Japan ..... 4-313342

[51] Int. Cl.[6] ..... F02D 41/04

[52] U.S. Cl. ..... 123/478

[58] Field of Search ..... 123/478, 480, 123/486, 492, 493, 488

[56] References Cited

U.S. PATENT DOCUMENTS

| | | | |
|---|---|---|---|
| 4,413,601 | 11/1983 | Matsuoka et al. | 123/480 |
| 4,549,516 | 10/1985 | Koumura | 123/478 |
| 4,590,563 | 5/1986 | Matsumura et al. | 123/488 |
| 4,649,877 | 3/1987 | Yasuoka et al. | 123/480 |
| 4,662,339 | 5/1987 | Hotate et al. | 123/478 |
| 4,708,115 | 11/1987 | Yamato et al. | 123/478 |
| 4,823,755 | 4/1989 | Hirose et al. | 123/480 |
| 5,095,877 | 3/1992 | Kikuchi et al. | 123/492 |
| 5,218,941 | 6/1993 | Suzuki et al. | 123/478 |

FOREIGN PATENT DOCUMENTS 63-183236 7/1988 Japan .

*Primary Examiner*—Willis R. Wolfe

*Attorney, Agent, or Firm*—Knobbe, Martens, Olson & Bear

[57] ABSTRACT

An air/fuel ratio control for an internal combustion engine which adjusts the fuel supply amount in response to correction factors dependent upon altitude and engine speed and altitude and engine load. In this way, it is not necessary to provide over-enriching of the fuel/air ratio to avoid overheating when high altitude or low atmospheric pressure conditions prevail.

40 Claims, 7 Drawing Sheets

T1: Memory (Table) of Basic Fuel Injection Duration TP

| N(rpm) \ Θ(°) | 10 | 20 | 30 | ---------- |
|---|---|---|---|---|
| 1000 | $TP_{11}$ | $TP_{12}$ | $TP_{13}$ | ---------- |
| 2000 | $TP_{21}$ | $TP_{22}$ | $TP_{23}$ | ---------- |
| 3000 | $TP_{31}$ | $TP_{32}$ | $TP_{33}$ | ---------- |
| 4000 | $TP_{41}$ | $TP_{42}$ | $TP_{43}$ | ---------- |
| ⋮ | ⋮ | ⋮ | ⋮ | ---------- |

*Figure 6*

T2: Memory (Table) of Correction Factor Fn - Atm. Pressure vs Engine Speed

| PA(mmHg) / N(rpm) | 450 | 500 | 550 | ---------- |
|---|---|---|---|---|
| 1000 | $Fn_{11}$ | $Fn_{12}$ | $Fn_{13}$ | ---------- |
| 2000 | $Fn_{21}$ | $Fn_{22}$ | $Fn_{23}$ | ---------- |
| 3000 | $Fn_{31}$ | $Fn_{32}$ | $Fn_{33}$ | ---------- |
| 4000 | $Fn_{41}$ | $Fn_{42}$ | $Fn_{43}$ | ---------- |
| ⋮ | ⋮ | ⋮ | ⋮ | ---------- |

*Figure 7a*

T1: Memory (Table) of Basic Fuel Injection Duration TP

| PA(mmHg) / Θ(°) | 450 | 500 | 550 | ---------- |
|---|---|---|---|---|
| 10 | $F\theta_{11}$ | $F\theta_{12}$ | $F\theta_{13}$ | ---------- |
| 20 | $F\theta_{21}$ | $F\theta_{22}$ | $F\theta_{23}$ | ---------- |
| 30 | $F\theta_{31}$ | $F\theta_{32}$ | $F\theta_{33}$ | ---------- |
| 40 | $F\theta_{41}$ | $F\theta_{42}$ | $F\theta_{43}$ | ---------- |
| ⋮ | ⋮ | ⋮ | ⋮ | ---------- |

*Figure 7b*

AIR-TO-FUEL RATIO CONTROL UNIT FOR INTERNAL COMBUSTION ENGINE

BACKGROUND OF THE INVENTION

This invention relates to an air/fuel ratio control unit for an internal combustion engine, and more particularly to an improved method and apparatus for controlling the air/fuel ratio of an engine in response to parameters including altitude changes.

As should be readily apparent, it is extremely desirable to provide an accurate air/fuel ratio control for internal combustion engines not only to improve fuel economy but also to reduce unwanted exhaust gas emissions. Therefore, a wide variety of types of control strategies have been provided. Basically, the fuel/air ratio is controlled in response to engine speed and load as determined by throttle opening or another parameter. However, it also known that the desirable air/fuel ratio is dependent upon atmospheric pressure or altitude. Therefore, it has been the practice to provide altitude or atmospheric pressure compensation for the air/fuel ratio to further improve engine performance and fuel economy. However, the previously proposed systems have not been completely effective in providing such control.

The reason for this can be best understood by reference to FIG. 1 which is a family of curves showing engine power and fuel supply amount per revolution of the engine at various engine speeds. As may be seen, as the engine speed increases, the amount of fuel required to produce maximum power also increases. The curves N1, N2, N3, N4, and N5 show the curves at 5 progressively increasing engine speeds. The points Q1, Q2, Q3, Q4, and Q5 indicate the optimum fuel to be supplied to the engine to achieve maximum horsepower. However, most control strategies adopt a fuel control that increases the amount of fuel supplied to the engine above that required for maximum power at high speed, high load conditions. This is done to insure against over-heating.

When conventional systems make altitude compensation they follow fuel supply curves shown by the dotted line curves and the quantity of fuel supplied is varied generally proportionally to the increase in altitude so that as the altitude increases or atmospheric pressure decreases at low speeds the fuel supply is changed from Q1 to Q1*a*. At the higher engine speed N5 the fuel set at standard pressure is on the rich side and is picked as the amount Q5' rather than Q5. This is done for the aforenoted reason. Therefore, if the altitude increases, the fuel is decreased in the same proportion to the point Q5'*a*. It has been found that excess fuel is supplied. The reason for this is that the engine temperature tends to decrease as the altitude increases with all other factors constant. Therefore, it is not necessary to provide the additional enrichment to avoid over-heating when the altitude increases.

It is, therefore, a principal object of this invention to provide an improved method and apparatus for controlling the air/fuel ratio for an internal combustion engine and making appropriate altitude compensation therein.

It is a further object of this invention to provide an engine fuel supply control that will insure against over-heating under a high speed high load conditions but which will not be overly rich when the altitude increases or atmospheric pressure decreases.

It is a further object of this invention to provide an improved fuel/air supply and control wherein in addition to altitude compensation other factors such as engine speed and/or load are also reflected in the altitude compensation.

SUMMARY OF THE INVENTION

A first feature of this invention is adapted to be embodied in an air/fuel ratio control for an internal combustion engine having a charge-forming device for supplying at least fuel to the engine for its operation. Control means control the charge-forming device to control the amount of fuel supplied to the engine by the charge-forming device. Means are provided for measuring at least two engine running conditions for determining a basic fuel supply amount. This basic fuel supply amount provides a greater amount of fuel than that required to produce maximum power as the speed or load of the engine increases to its high end. Means are provided for sensing atmospheric pressure.

In accordance with an apparatus for performing the invention, means correct the amount of fuel supplied to the engine by the charge-forming device in response to decreases in atmospheric pressure to decrease the amount of fuel supplied as the atmospheric pressure decreases and to change the amount of decrease in response to one of the speed or load on the engine.

In accordance with a method for practicing the invention, the amount of fuel supplied to the engine by the charge-forming device is decreased in response to decreases in atmospheric pressure and the amount of decrease is increased as the speed or load of the engine increases.

Another feature of the invention is adapted to also be employed in a fuel/air ratio control for an internal combustion engine having a charge-forming device for supplying at least fuel to the engine for its operation. Control means control the charge-forming device to control the amount of fuel supplied to the engine by the charge-forming device. Means are provided for measuring at least two engine running conditions for determining a basic fuel supply amount. Means are provided for measuring both the atmospheric pressure and the speed and load of the engine.

In accordance with an apparatus for performing the invention, the control means corrects the basic fuel supply amount by two correction factors, one dependent upon the altitude and engine speed and the other dependent upon the altitude and load on the engine.

BRIEF DESCRIPTION OF THE DRAWINGS

FIG. 6 is a representation of the memory of the basic fuel injection duration (T1).

FIG. 7, part A, is a representation of the memory of correction factor of atmospheric pressure versus engine speed (T2); part B is a representation of the memory of correction factor for atmospheric pressure versus engine load indicator (T3).

DETAILED DESCRIPTION OF THE PREFERRED EMBODIMENT OF THE INVENTION

Figure 1:
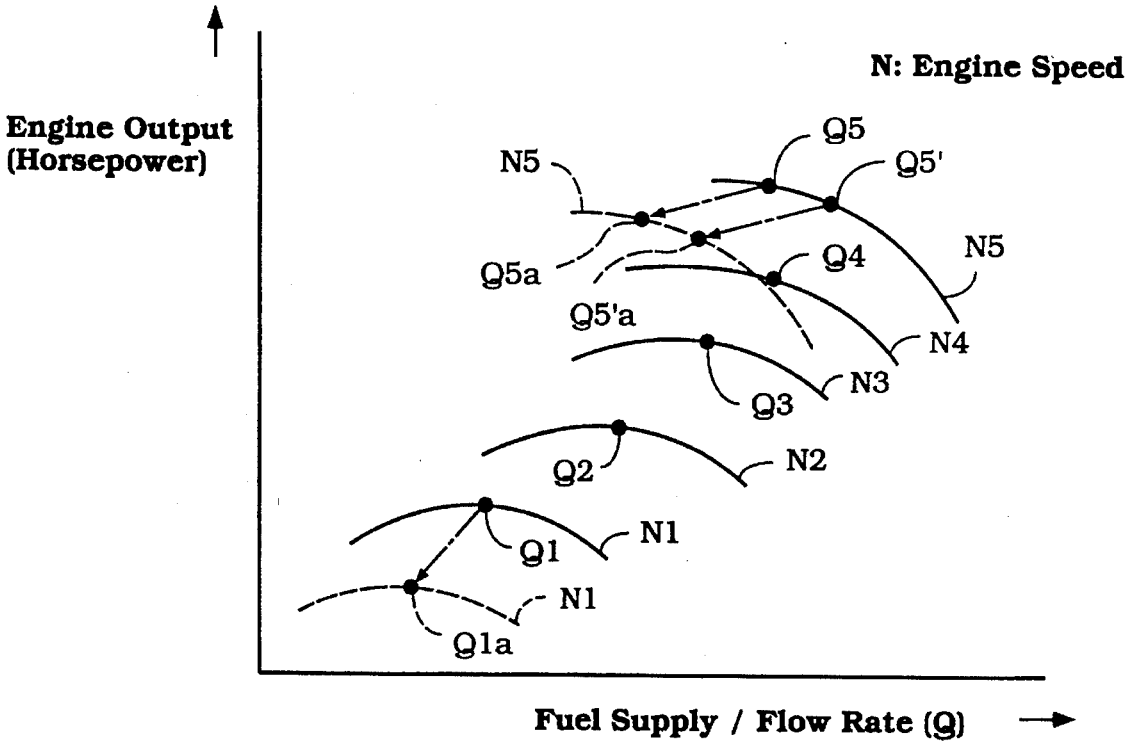
FIG. 1 is a family of curves showing engine power and fuel supply amount per revolution of the engine at various engine speeds.

As previously described, FIG. 1 shows a family of curves representing optimum fuel supply or flow rates (Q) as a function of engine power and engine speed. It is a principal object of this invention to provide an improved method and apparatus for controlling the air/fuel ratio for an internal combustion engine shown in a preferred embodiment in FIG. 2. As can be observed in FIG. 1, as the engine speeds become progressively greater, the amount of fuel required to produce maximum power also increases. The curves N1, N2, N3, N4, and N5 show five progressively increasing engine speeds, and the points Q1, Q2, Q3, Q4, and Q5 represent the optimum fuel at each speed to be supplied for maximum horsepower. At high speeds, such as N5, a fuel-rich fuel/air mix Q5' is typically chosen to provide for engine cooling at such high speed, high load condition.

With conventional control strategies, a compensation for increased altitude or decreased atmospheric pressure follows the dotted line curves, whereby at low speed N1 the optimum fuel rate changes from Q1 to Q1*a* and at high speed N5 the optimum fuel rate changes from Q5 to Q5*a*, or from Q5' to Q5'*a*. It is to be noted that the compensation for engine cooling at the high speed provides for overly rich fuel/air mix at an increased altitude or decreased atmospheric pressure being based generally upon a one atmosphere of pressure condition. An improvement upon this compensation for solely atmospheric pressure decrease or altitude increase is the advantage of the present invention.

Figure 2:
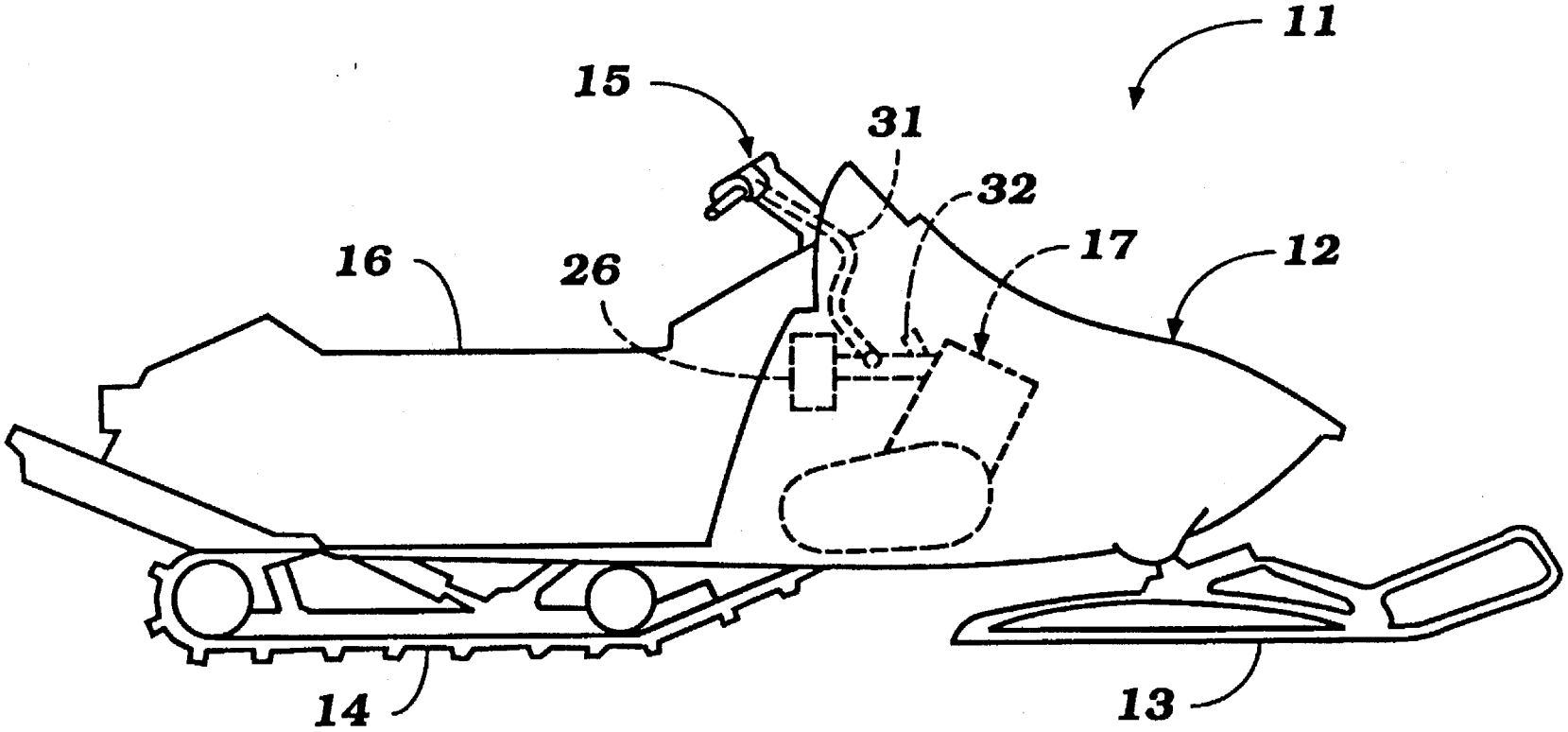
FIG. 2 is a side elevational view of a snowmobile constructed in accordance with an embodiment of the invention.

Referring now in detail to FIG. 2, a snowmobile constructed and operated in accordance with an embodiment of the invention is identified generally by the reference numeral 11. The invention is described in conjunction with a snowmobile because this is a typical environment in which the invention may find utility. As will become apparent, the invention deals primarily with the controls for the powering internal combustion engine of the snowmobile 11 and snowmobiles provide the type of environment where the invention, which compensates for altitude in concert with engine speed and engine load, is useful. It will be obvious to those skilled in the art that the invention can be employed with other applications for internal combustion engines.

The snowmobile 11 includes a body 12 that is suspended upon a pair of steering skis 13 at the front and a drive belt 14 at the rear. The skis 13 and drive belt 14 suspend the body 13 through any known type of suspension systems.

A handlebar assembly 15 is supported on the body 12 forwardly of a rider's seat 16 for controlling the steering of the skis 13 in a well-known manner. Other controls for the snowmobile 11 are also carried by the handlebar assembly 15, as will become apparent.

Figure 3:
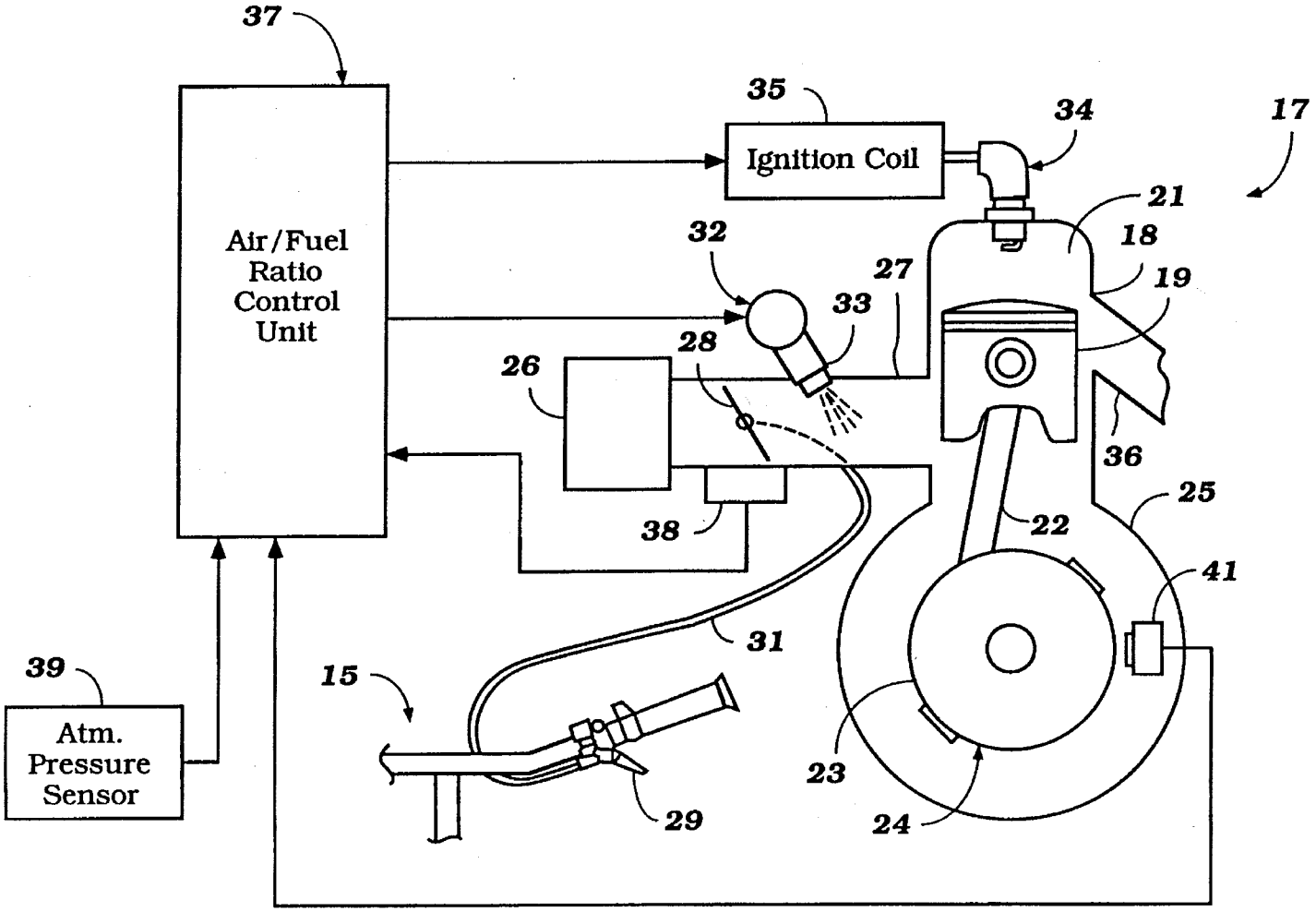
FIG. 3 is a partially schematic cross-sectional view taken through a single cylinder of the engine and shows the interrelationship with the throttle control and other controls for the system.

An internal combustion engine, indicated generally by the reference numeral 17 and shown in most detail in FIG. 3, is mounted in the body 12 and drives the drive belt 14 through a suitable transmission which includes a centrifugal clutch (not shown).

Referring now in detail to FIG. 3, the engine 17 is depicted partially in schematic form and as a cross section through a single cylinder. Since the internal details of the engine 17 are not necessary to understand the construction and operation of the invention, they will be described only summarily. Where a detailed description is omitted, it may be considered to be conventional.

The engine 17 includes a cylinder block 18 having one or more cylinder bores in which pistons 19 are supported for reciprocation. The pistons 19 and cylinder bores as well as an attached cylinder head define a combustion chamber 21.

The pistons 19 are connected by means of connecting rods 22 to the throws 23 of a crankshaft, indicated generally by the reference numeral 24, and supported within a crankcase 25 in a known manner. In the illustrated embodiment, the engine 17 operates on a two-stroke crankcase compression principle, although it should be readily apparent to those skilled in the art that the invention can be employed with engines operating on other principles.

As a two-stroke engine, the crankcase chambers associated with each of the pistons 19 are sealed from each other, and a fuel/air charge is delivered to the crankcase chambers through an induction system that includes an air cleaner 26 which draws atmospheric air from within the body 12 and delivers it to an induction manifold 27. A flow controlling throttle valve 28 is provided in the induction manifold 27 and the throttle valve 28 is controlled by a throttle lever 29 mounted on one side of the handlebar assembly 15. A bowden wire actuator 31 or other motion transmitting mechanism interconnects the throttle control lever 29 with the throttle valve 28.

A charge forming system is provided for supplying a fuel/air charge to the intake manifold 27, and in the illustrated embodiment this charge-forming embodiment includes an electrically operated fuel injector 32 having a discharge nozzle 33 that sprays fuel into the intake manifold 27 downstream of the throttle valves 28. Although manifold injection is disclosed, it is to be understood that the invention may also be employed in conjunction with direct cylinder injection or other types of charge-forming systems such as carburetors or the like.

The charge formed in the induction system is delivered to the crankcase chambers through the intake manifold 27 and reed-type check valves (not shown) are provided at the discharge point so as to preclude reverse flow when the charge is being compressed by the downward movement of the pistons 19, as is well-known in this art.

The charge compressed in the crankcase chambers is then transferred to the combustion chambers 21 by scavenging passages (not shown). This charge is then fired by a spark plug 34 mounted in the cylinder head of the engine and having its spark gap extending into the combustion chamber 21. An ignition coil 35 is connected to the spark plug 34 for its firing, and the ignition coil 35 is controlled in a manner which will be described.

When the charge in the combustion chamber 21 is fired by the spark plug 34, the pistons 19 will be driven downwardly and eventually will open exhaust ports 36 which communicate with an exhaust system (not shown) for the discharge of the exhaust gases to the atmosphere.

The fuel injector 32 and ignition system including the ignition coil 35 are controlled by an air/fuel ratio control unit, indicated generally by the reference numeral 37 and which receives certain signals from the engine 17 and ambient conditions so as to provide the appropriate timing and duration of fuel injection by the injector 32 and timing of firing of the spark plug 34. An embodiment of the control logic of the invention for said fuel injection is summarized in FIGS. 4 and 5 and will be further described.

The construction thus far described may be considered to be conventional and, for that reason and as previously noted, full details of the construction are not believed to be necessary to understand the construction and operation of the invention. The invention deals primarily with the control system for compensation of the fuel/air ratio to provide greater fuel efficiency and greater engine performance in the presence of reduced atmospheric pressure or increased altitude. As previously noted, unlike the invention, conventional systems do not compensate for the additional parameters of the engine speed or the engine load.

The engine control system of the invention includes a throttle position detector 38 that outputs a signal to the air/fuel ratio control unit 37, which is indicative of the position of the throttle valve 28. In addition, an atmospheric pressure sensor 39 is suitably mounted on the snowmobile 11. The atmospheric pressure sensor 39 may take the form of a manometer, which sensors are commonly known by those of ordinary skill in the art.

There is further provided an engine speed sensor 41 of any known type, which cooperates with the crankshaft 24 for providing output pulses for each revolution of the crankshaft 24 so as to provide data by which the air/fuel ratio control unit 37 may determine the engine speed N. It should be noted that some or all of the sensors 38, 39, and 41 may also be employed in another engine control or protection system, which will not be detailed in the discussion of the present invention. Since said sensors 38, 39, and 41 may be of any known type, further description of these components are not believed to be necessary to understand the construction and operation of this invention.

Figure 4:
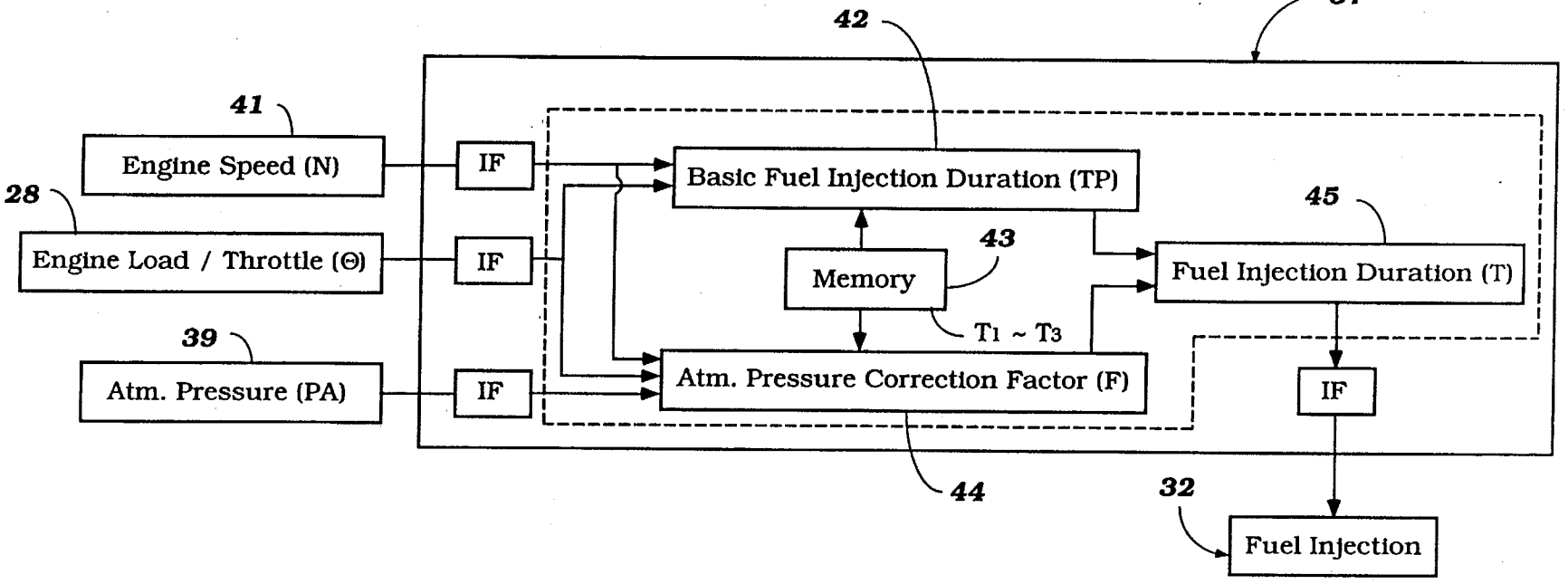
FIG. 4 is a block diagram of the control routine.

The air/fuel ratio control unit 37 utilizes the sensor signals of engine speed N, throttle valve position θ (as an indication of the load on the engine), and atmospheric pressure PA. Based on these inputs, an air/fuel ratio control routine of FIG. 4 is followed to determine, based on these parameters, an appropriate fuel injection rate (i.e., both fuel injection timing and fuel injection duration). The control routine is active during the entirety of the vehicle operation in order to provide for optimum engine performance and fuel economy. As previously described, a conventional correction for altitude or atmospheric pressure includes a sub-optimal fuel-rich mix at high speed, high load conditions at low atmospheric pressures, said fuel-rich mix being avoided in the control routine of the invention through application of engine speed and engine load correction factors.

As indicated in FIG. 4, the load on the engine, as indicated by the throttle position θ, and the engine speed N are read for determination of a basic fuel injection duration TP. A basic fuel injection rate calculating section 42 determines the basic fuel injection duration TP utilizing a memory 43, shown in FIG. 6, based on the engine speed N versus the engine load indicator θ, shown as a Table T1. The basic fuel injection duration Table T1 is based on engine operation at one atmosphere of pressure, i.e. sea level.

The memory 43 of correction factors for atmospheric pressure versus either engine speed N and engine load indicator θ are shown in FIG. 7 as the Tables T2 and T3.

The atmospheric pressure PA is detected by the air/fuel ratio control unit 37 for determination of an appropriate correction factor. An atmospheric pressure correction factor calculating section 44 derives the appropriate correction factor as a function of both the atmospheric pressure PA and the engine load indicator θ, and the atmospheric pressure PA and the current engine speed N.

In the determination of a final correction factor F, a contribution from the atmospheric pressure PA and engine speed N, and a contribution from the atmospheric pressure PA and engine load indicator γ, are combined in a function to determine said final factor F. The final correction factor F, along with the basic fuel injection duration TP, are combined in a total fuel injection duration calculating section 45. A final fuel injection duration T is then commanded to the fuel injector 32 by the air/fuel ratio control unit 37. While in this embodiment both engine speed and engine load factors are combined, it is understood that one or another may be a correction in conjunction with atmospheric pressure in embodiments not specifically disclosed herein.

Figure 5:
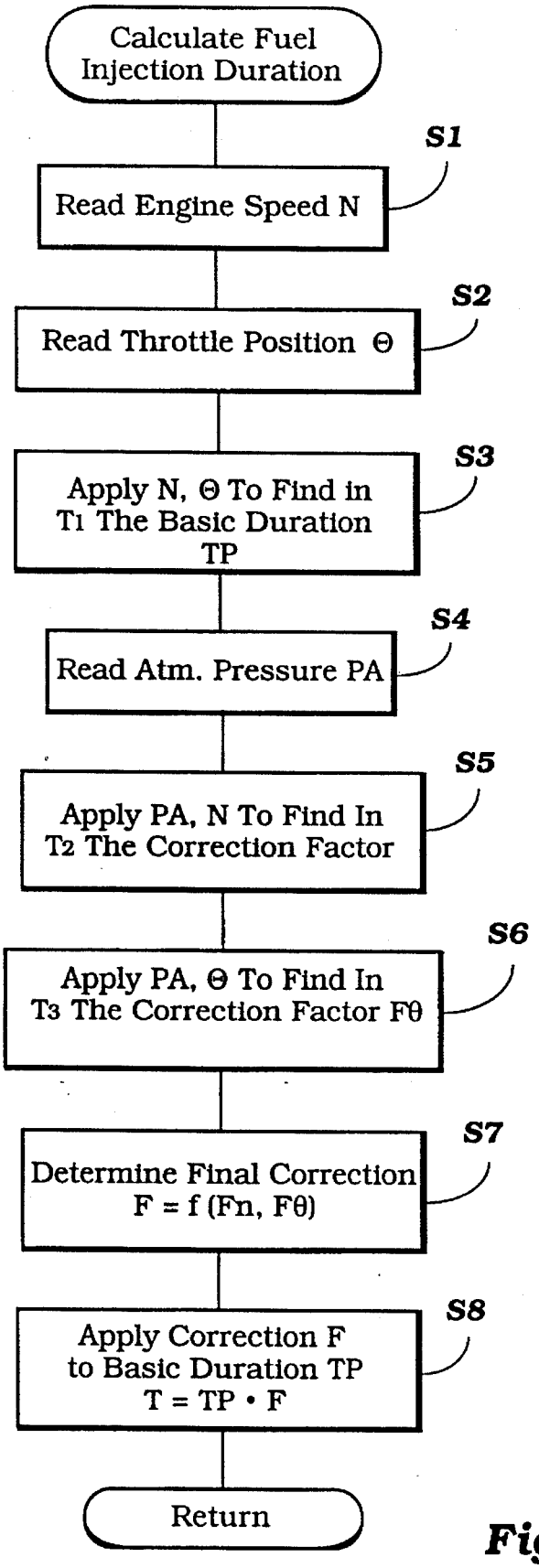
FIG. 5 is a flow diagram of the fuel injection duration calculation, utilizing the basic fuel injection duration plus correction factors for atmospheric pressure and engine speed or atmospheric pressure and engine load.

Details of a specific control logic for the fuel injection duration calculation of the air/fuel ratio control unit 37 are shown in FIG. 5. The calculation of the fuel injection duration begins at step S1 with the reading of the engine speed N, and continues at step S2 with the reading of the throttle position θ as an indication of the load on the engine. At step S3, these two values are applied to find, via Table T1, the basic value of the fuel injection duration TP. The Table T1 is based upon an engine operating condition at one atmosphere of pressure (sea level), or 760 mm Hg.

Next, at step S4 the atmospheric pressure PA is read, and in step S5 this value, in conjunction with the engine speed N, is applied to find a correction factor $F_n$ using Table T2. The atmospheric pressure PA and the engine load indicator θ are applied to find a correction factor $F_\theta$ using Table T3, as indicated at step S6.

The final correction factor F is determined as a function of the correction factors for atmospheric pressure PA and engine speed N, $F_n$, and atmospheric pressure PA and engine load indicator θ, $F_\theta$. This calculation is shown at step S7, and the application of this final correction factor F to the basic duration TP is shown at step S8. The combining function to achieve the final correction factor F, as well as the simple multiplication function shown in step S8, may vary in alternate embodiments and are not further addressed herein; however, said alternate functions to achieve the final fuel injection rate command are considered to be encompassed by this invention.

As discussed previously, the values corresponding to the basic fuel injection duration TP and the correction factors $F_n$ and $F_\theta$ are calculated using tables of values T1–T3 located in the memory 43, these values representing a range of engine operating conditions. Subsets of the potential values for engine speed N, throttle position θ, and atmospheric pressure PA are utilized in these tables, with the actual values read being interpolated between the table values. The table look-up and interpolation scheme enable a large range of data to be stored in a relatively small amount of memory. Thus, a wide variety of engine operating conditions, known to those skilled in the art, are capable of being controlled by the invention.

Through the aforementioned air/fuel ratio control logic, the air/fuel ratio control unit 37 is able to more optimally determine the required fuel supply in order to improve the fuel economy and engine performance of an internal combustion engine embodiment, without an over-enriched fuel/air mix and unnecessary engine cooling in high altitude or lower atmospheric pressure conditions.

It should be understood that the described control routine is designed primarily for an extreme condition of increased altitude or decreased atmospheric pressure. Of course, it should be readily apparent to those skilled in the art that benefits in fuel economy and engine performance are also realized under other conditions of less extreme altitude increase or atmospheric pressure decrease. Also, it is to be understood that the described construction is that of a preferred embodiment of the invention and various other changes and modifications may be made without departing from the spirit and scope of the invention, as defined by the claims.

I claim:

1. An air/fuel ratio control for an internal combustion engine having a charge-forming device for supplying at least fuel to said engine for its operation, control means for controlling said charge-forming device to control the amount of fuel supplied to said engine by said charge-forming device, means for measuring at least two engine running conditions for determining a basic supply amount of fuel, said control means providing a richer fuel/air ratio as one of the speed and load of the engine increases to provide a richer fuel/air ratio than required to produce maximum power, means for measuring atmospheric pressure, and means for decreasing the amount of fuel supplied by said charge-forming device as the atmospheric pressure decreases with the amount of decrease of fuel supply being increased as the speed or load on the engine increases so as to provide a fuel/air ratio not greater than that required to produce maximum power.

2. The air/fuel ratio control for an internal combustion engine of claim 1, wherein at least one of the two engine running conditions comprising engine speed.

3. The air/fuel ratio control for an internal combustion engine of claim 1, wherein at least one of the two engine running conditions comprises throttle opening.

4. The air/fuel ratio control for an internal combustion engine of claim 3, wherein the other engine running condition comprises engine speed.

5. The air/fuel ratio control for an internal combustion engine of claim 1, wherein the correction for altitude is dependent upon atmospheric pressure and speed.

6. The air/fuel ratio control for an internal combustion engine of claim 1, wherein the atmospheric pressure correction depends upon atmospheric pressure and throttle valve opening.

7. The air/fuel ratio control for an internal combustion engine of claim 6, wherein the atmospheric pressure correction is also dependent upon atmospheric pressure and engine speed.

8. The air/fuel ratio control for an internal combustion engine of claim 1, wherein the basic fuel supply amount is chosen to produce maximum power at lower engine speeds.

9. The air/fuel ratio control for an internal combustion engine of claim 8, wherein the amount of fuel supplied as the altitude increases and the speed increases is decreased to that approximately equal to the amount necessary to produce maximum power.

10. The air/fuel ratio control for an internal combustion engine of claim 9, wherein at least one of the two engine running conditions comprising engine speed.

11. The air/fuel ratio control for an internal combustion engine of claim 9, wherein at least one of the two engine running conditions comprises load.

12. The air/fuel ratio control for an internal combustion engine of claim 11, wherein the other engine running condition comprises engine speed.

13. The air/fuel ratio control for an internal combustion engine of claim 9, wherein the correction for altitude is dependent upon atmospheric pressure and speed.

14. The air/fuel ratio control for an internal combustion engine of claim 9, wherein the atmospheric pressure correction depends upon atmospheric pressure and throttle valve opening.

15. The air/fuel ratio control for an internal combustion engine of claim 14, wherein the atmospheric pressure correction is also dependent upon atmospheric pressure and engine speed.

16. An air/fuel ratio control for an internal combustion engine having a charge-forming device for supplying at least fuel to said engine for its operation, control means for controlling said charge-forming device to control the amount of fuel supplied to said engine by said charge-forming device, means for measuring at least two engine running conditions for determining a basic fuel supply amount, means for measuring atmospheric pressure, means for measuring load on the engine, means for measuring the engine speed, means for providing a first correction factor in the basic fuel supply amount in response to altitude and engine speed, and means for providing a second correction factor in response to altitude and measured engine load to provide an air fuel ratio no greater than that required to produce maximum power at high altitudes.

17. The air/fuel ratio control for an internal combustion engine of claim 16, wherein the engine load is measured by means for sensing the position of the throttle of the engine.

18. The air/fuel ratio control for an internal combustion engine of claim 16, wherein at least one of the two engine running conditions comprising engine speed.

19. The air/fuel ratio control for an internal combustion engine of claim 16, wherein at least one of the two engine running conditions comprises load.

20. The air/fuel ratio control for an internal combustion engine of claim 19, wherein the other engine running condition comprises engine speed.

21. An air/fuel ratio control method for an internal combustion engine having a charge-forming device for supplying at least fuel to said engine for its operation, control means for controlling said charge-forming device to control the amount of fuel supplied to said engine by said charge-forming device, said method comprising measuring at least two engine running conditions for determining a basic supply amount of fuel, providing a richer fuel/air ratio as one of the speed and load of the engine increases, measuring atmospheric pressure to provide a fuel/air ratio richer than that necessary to produce maximum power, and decreasing the amount of fuel supplied by said charge-forming device as the atmospheric pressure decreases with the amount of decrease of fuel supply being increased as the speed or load on the engine increases to provide a fuel/air ratio not greater than that required to produce maximum power at low absolute pressures.

22. The air/fuel ratio control method for an internal combustion engine of claim 21, wherein at least one of the two engine running conditions comprising engine speed.

23. The air/fuel ratio control method for an internal combustion engine of claim 21, wherein at least one of the two engine running conditions comprises load.

24. The air/fuel ratio control method for an internal combustion engine of claim 23, wherein the other engine running condition comprises engine speed.

25. The air/fuel ratio control method for an internal combustion engine of claim 21, wherein the correction for altitude is dependent upon atmospheric pressure and speed.

26. The air/fuel ratio control method for an internal combustion engine of claim 21, wherein the atmospheric pressure correction depends upon atmospheric pressure and load.

27. The air/fuel ratio control method for an internal combustion engine of claim 26, wherein the atmospheric pressure correction is also dependent upon atmospheric pressure and engine speed.

28. The air/fuel ratio control method for an internal combustion engine of claim 21, wherein the basic fuel supply amount is chosen to produce maximum power at lower engine speeds and is richer than that required to produce maximum power at higher engine speeds.

29. The air/fuel ratio control method for an internal combustion engine of claim 28, wherein the amount of fuel supplied as the absolute pressure decreases and the speed increases is decreased to that substantially equal to the amount necessary to produce maximum power at low absolute pressures.

30. The air/fuel ratio control method for an internal combustion engine of claim 29, wherein at least one of the two engine running conditions comprising engine speed.

31. The air/fuel ratio control method for an internal combustion engine of claim 29, wherein at least one of the two engine running conditions comprises load.

32. The air/fuel ratio control method for an internal combustion engine of claim 31, wherein the other engine running condition comprises engine speed.

33. The air/fuel ratio control method for an internal combustion engine of claim 29, wherein the correction for altitude is dependent upon atmospheric pressure and speed.

34. The air/fuel ratio control method for an internal combustion engine of claim 29, wherein the atmospheric pressure correction depends upon atmospheric pressure and load.

35. The air/fuel ratio control method for an internal combustion engine of claim 34, wherein the atmospheric pressure correction is also dependent upon atmospheric pressure and engine speed.

36. An air/fuel ratio control method for an internal combustion engine having a charge-forming device for supplying at least fuel to said engine for its operation, control means for controlling said charge-forming device to control the amount of fuel supplied to said engine by said charge-forming device, said method comprising the steps of measuring at least two engine running conditions for determining a basic fuel supply amount, measuring atmospheric pressure, measuring load on the engine, measuring the engine speed, providing a first correction factor in the basis fuel supply amount in response to altitude and engine speed, and providing a second correction factor in response to altitude and measured engine load to produce a fuel/air ratio no greater than that required to produce maximum power at low atmospheric pressures.

37. The air/fuel ratio control method for an internal combustion engine of claim 36, wherein the engine load is measured by means for sensing the position of the throttle of the engine.

38. The air/fuel ratio control method for an internal combustion engine of claim 36, wherein at least one of the two engine running conditions comprising engine speed.

39. The air/fuel ratio control method for an internal combustion engine of claim 36, wherein at least one of the two engine running conditions comprises load.

40. The air/fuel ratio control method for an internal combustion engine of claim 39, wherein the other engine running condition comprises engine speed.

* * * * *

UNITED STATES PATENT AND TRADEMARK OFFICE

CERTIFICATE OF CORRECTION

PATENT NO. : 5,462,031
DATED : October 31, 1995
INVENTOR(S) : Manabu Kai

It is certified that error appears in the above-identified patent and that said Letters Patent is hereby corrected as shown below:

Column 10,
Line 10, "basis" should be "basic"

Signed and Sealed this

Nineteenth Day of March, 2002

*Attest:*

*Attesting Officer*

JAMES E. ROGAN
*Director of the United States Patent and Trademark Office*